United States Patent [19]

Holze et al.

[11] Patent Number: 4,907,398

[45] Date of Patent: Mar. 13, 1990

[54] METHOD AND APPARATUS FOR THE AUTOMATIC FILLING OF TRAYS WITH UPRIGHT PRODUCTS

[75] Inventors: Joachim Holze, Monheim-Baumberg; Michael Kik, Langenfeld; Juergen Leitzen, Wuppertal; Helmut Korn, Dormagen; Hans Plotsch, Duesseldorf; Leo Meschler, Haan, all of Fed. Rep. of Germany

[73] Assignee: Henkel Kommanditgesellschaft auf Aktien, Dusseldorf-Holthausen, Fed. Rep. of Germany

[21] Appl. No.: 240,031

[22] Filed: Sep. 2, 1988

[30] Foreign Application Priority Data

Sep. 2, 1987 [DE] Fed. Rep. of Germany ..... 3729324

[51] Int. Cl.[4] ..... B65B 35/36; B65B 35/54

[52] U.S. Cl. ..... 53/443; 53/448; 53/473; 53/539; 53/543; 53/247; 53/250

[58] Field of Search ..... 53/148, 539, 543, 236, 53/247, 250, 252, 444, 448, 475, 473, 48, 443

[56] References Cited

U.S. PATENT DOCUMENTS

| | | | |
|---|---|---|---|
| 3,327,450 | 6/1967 | Carter | 53/539 X |
| 3,431,702 | 3/1969 | Spaulding | 53/543 X |
| 3,505,787 | 4/1970 | Tiews | 53/539 |
| 3,601,951 | 8/1971 | Bargel et al. | 53/539 X |
| 3,805,484 | 4/1974 | Rossi | 53/543 |
| 3,826,382 | 7/1974 | Zappia | 53/247 X |
| 3,948,018 | 4/1976 | Rowekamp | 53/539 X |
| 4,191,003 | 3/1980 | Talarico | 53/539 X |
| 4,233,802 | 11/1980 | Booth et al. | 53/539 X |
| 4,429,512 | 2/1984 | Pegon, Jr. | 53/539 X |
| 4,790,116 | 12/1988 | Stridh | 53/543 X |

*Primary Examiner*—Horace M. Culver

*Attorney, Agent, or Firm*—Ernest G. Szoke; Wayne C. Jaeschke; Real J. Grandmaison

[57] ABSTRACT

To load products, particularly lipsticks or glue sticks, delivered upright from a packing unit, into a plurality of receiving trays, the products are grouped in at least two rows in a segregating station, conveyed in spaced groups to a transfer station, and moved to a filling station into a prepared tray by means of a handling unit equipped with a gripper means. Each tray, filled with products, is removed from the filling station by an output conveyor and is replaced with a similar empty tray while another group of products is formed and moved into the transfer station.

19 Claims, 3 Drawing Sheets

METHOD AND APPARATUS FOR THE AUTOMATIC FILLING OF TRAYS WITH UPRIGHT PRODUCTS

BACKGROUND OF THE INVENTION

1. Field of the Invention

This invention relates to a method for placing at least two rows of uniform, narrow, upright products such as stick-like containers for a chemical product, lipstick or glue, into trays. The invention also relates to an apparatus for carrying out this method automatically.

2. Statement of Prior Art

For transport from the manufacturer to the retailer and/or for display by the retailer, narrow, elongate products such as glue sticks, lipsticks or the like are arranged in upright position in trays so that they can be individually selected and removed by customers without disturbing the remaining products. The products are also placed upright in the recesses or compartments of the trays to prevent them from rubbing together and damaging one another. Whereas the production of such products is largely automated, their placement in trays is still done by hand.

SUMMARY OF THE INVENTION

The present invention provides a method and an apparatus for the automatic insertion of upright products or containers into trays, to avoid the manual work hitherto involved, for economic and ergonomic reasons.

The invention is characterized by moving a supply of products in upright position, guiding the products into parallel rows, corresponding to the number of rows of recesses within a receiving tray, and moving the rows of products into a preliminary loading zone. In the loading zone, the rows of products are divided up or segregated into groups containing a predetermined number of said products corresponding to the number of recesses or empty tray positioned for filling with a said group of said upright products. Each group of products is moved into a transfer station containing a means for gripping each said group as a whole, lifting each said gripped group, moving it into position over a positioned tray, lowering said group into the tray and relaxing the grip to release the products into the tray recesses.

The present apparatus is characterized by a product conveyor belt including means for arranging a supply of products delivered upright thereon into parallel rows of products, means for segregating said parallel rows into groups of products corresponding to the location and number of the recesses or compartments of a particular receiving tray, and for conveying said groups into a transfer station. The apparatus further includes tray conveyor belt for delivering individual receiving trays to a carriage to be shifted into a filling station to receive a group of upright products. The transfer station includes a handling unit for gripping and lifting each group in sequence and for lowering and releasing the products into a tray delivered to the filling station by means of the carriage. In a preferred embodiment, at least one alignment means such as a tongue mounted to pivot about a vertical axis, is provided over the product conveyor belt in the path of the continuous supply of products being delivered upright thereon, in order to deflect the products into row-forming tracks of a preliminary loading zone in which the rows are segregated into short parallel rows forming said groups of products.

The present invention replaces the tiring and labor-intensive manual placement of narrow, elongate containers or sticks, for example containing 30 ml of product and having a diameter-to-length ratio of the order of 3 cm to 11 cm, with an automatic cycle which can be smoothly integrated into an existing tray packing line.

In the method and apparatus of the present invention, the narrow products are first aligned and grouped in two or more rows, such as in two rows of five or three rows of four products, depending upon the particular trays being filled. By means of a pneumatic handling system, each group of containers aligned in parallel rows is engaged, lifted, moved and lowered into a waiting tray. A pneumatically-operable, rotatable and vertically and horizontally displaceable gripper head mounted on a handling unit is advantageously used for this purpose.

While each ordered group of upright containers is being formed and positioned, a tray is delivered to the filling position for each group. The tray may be taken from a stack of trays. A conventional tray unstacking unit having a magazine is preferably provided for unstacking individual trays. A carriage shaped to fit each tray preferably is used for receiving and delivering each individual to the filling station tray to receive a group of upright products. The carriage moves each empty tray from the outlet of the tray stack to a filling position within the filling station in which it is precisely aligned to receive each product of the group into a particular recess or compartment of the tray in upright position to fill the tray.

For satisfactory operation of the automated apparatus as a whole, each tray and/or each group of products, containers or sticks delivered by a handling unit should be oriented and adjusted relative to one another in such a way that each group of products assumes its correct final position solely by lowering it into each tray. Thereafter, each filled tray is removed from the filling station, for example by means of a following conveyor installation.

DETAILED DESCRIPTION

Figure 1:
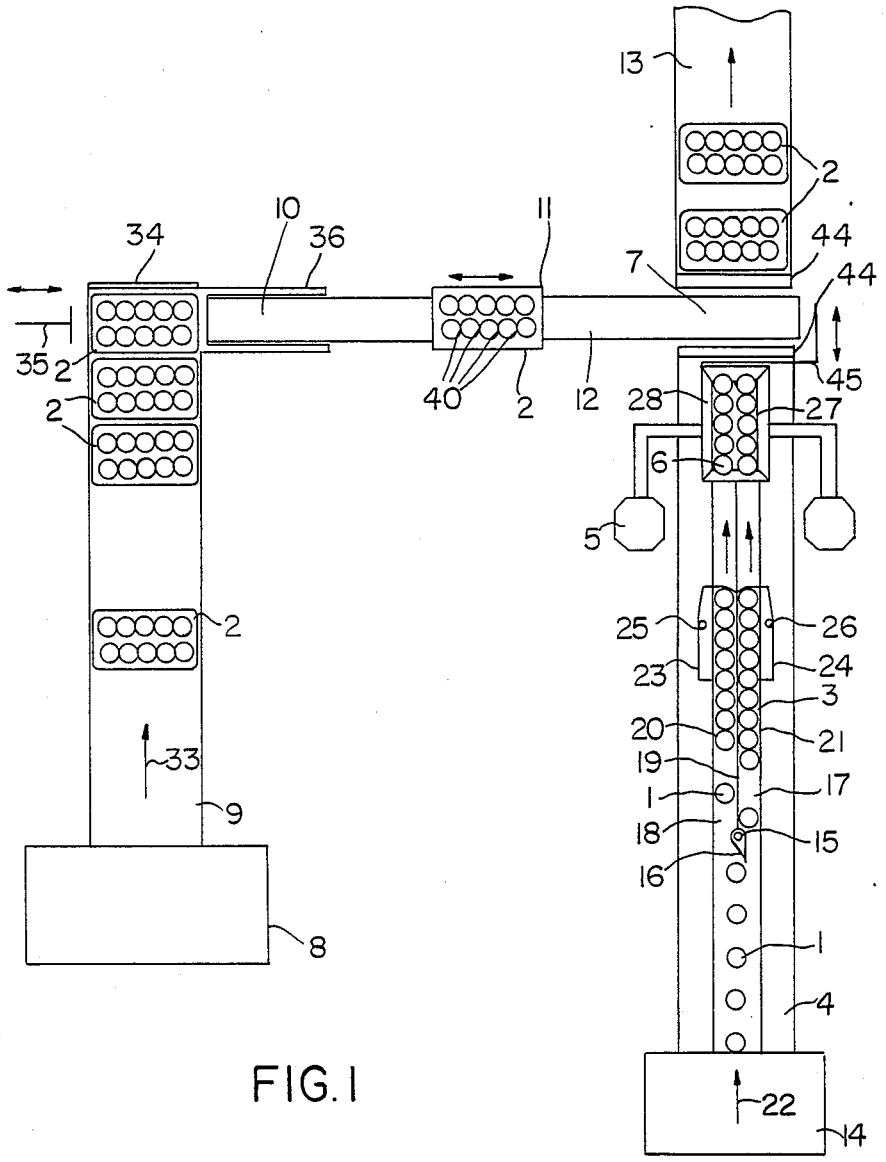
FIG. 1 is a plan view of an apparatus according to one embodiment of the present invention.

In the embodiment shown in FIG. 1, an apparatus for placing a group containing two rows of upright products 1, such as containers for a chemical product, lipstick or glue, into a receiving tray 2 consists of a loading zone, generally denoted by the reference 3, on a product conveyor belt 4, a handling unit 5 for the placement of a preceding group 6 or products into a tray 2 positioned at a tray filling station, generally denoted by the reference 7. The apparatus further includes a tray unstacking unit 8 associated with a tray conveyor belt 9 leading to a tray positioning station 10. The latter is associated with a tray carriage 11 movable over a carriage guide rail 12 connecting the tray positioning station 10 to the tray filling station 7. Finally the apparatus includes an output conveyor belt 13 for removing each filled tray from the filling station 7.

By means of the first or product conveyor belt 4, the upright products 1 are conveyed as a continuous supply from a preceding packing unit 14, at a desired linear speed and are delivered at the speed of travel of the belt to an alignment tongue 16 mounted to pivot about a vertical axis 15 at a predetermined distance above the conveyor belt 4. The tongue 16 is pivoted back and forth commensurately with the speed of travel of the belt and with the spacing between the arriving upright products 1 in such a way that the products 1 are alternately deflected to the right and left into a right-hand track 17 and left-hand track 18 of the preliminary loading zone 3. The tongue 16 is preferably designed and mounted in such a way that it is alternately deflected to the right and left at the desired rhythm by engagement with the arriving products 1 themselves.

The tracks 17 and 18 of the loading zone 3 are bounded by center guide plate or wall 19 and outside guide plates or walls 20 and 21. In the conveying direction 22, the rows of products 1 situated in the tracks 17 and 18 of the loading zone 3 are first retained by rotatably mounted pivotal flaps 23 and 24. In the embodiment illustrated, the pivotal flaps 23 and 24 are mounted on vertical spindles 25 and 26. They have the shape shown in principle in FIG. 1 which enables groups 6 of sticks to be first formed and then further transported by the conveyor belt 4, in the conveying direction 22, separately from the following products 1 through a pivotal movement about the spindles 25, 26.

In the embodiment illustrated, five products 1 are divided off in each row per track 17, 18 of the loading zone 3 by pneumatic operation of the pivotal flaps 23 and 24, and the group 6 of ten products is released and moved into the loading zone 27 by means of the conveyor belt 4. The group 6 of products 1 remains in the loading zone 27 until it is gripped and raised by the handling unit 5. In order simultaneously to collect and group further products 1 in the loading zone 3, the pivotal flaps 23 and 24 are turned back again after releasing each group so that another group of products 1 which have collected can enter the region between the flaps in an upright position, but cannot be further transported to the actual loading zone 27 until they are released.

The illustrated pneumatic handling unit 5 is a modular system comprising three pneumatic cylinders and a rotary unit for producing linear movements in one plane and a rotational movement of a gripper head 28 which is fixed to the rotary unit of the handling unit 5, its function being to grip and lift a group 6 of products 1 positioned in the loading zone 27.

Figure 2:
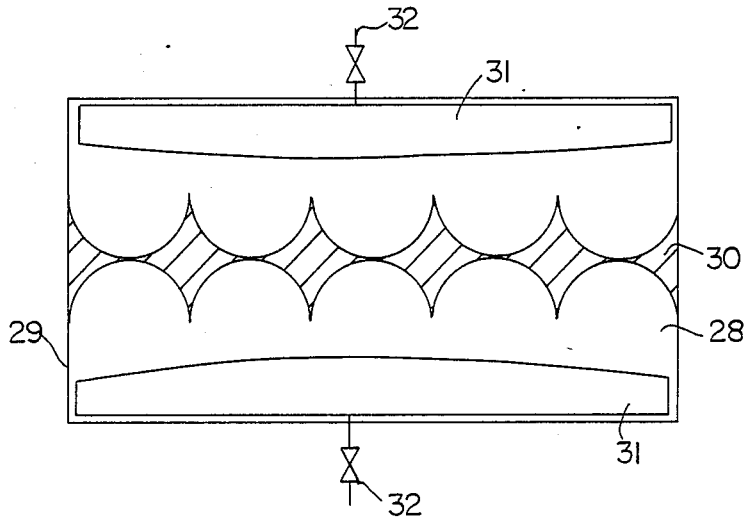
FIG. 2 is a horizontal section through a gripper head for a group of ten containers or sticks, as present on the apparatus of FIG. 1.

As illustrated in FIG. 2, the gripper head 28 consists of a centering frame 29 having a rigid core 30. In the lateral boundary of the gripper head 28 are mounted flexible pneumatic rubber pads 31 connected to compressed-air supply lines 32. The mutual arrangement of the core 30 and the rubber pads 31 is such that, in the deflated state of the rubber pads 31, the centering frame 29 can be lowered to loosely surround the upright products 1 in a group 6 in the loading zone 27. By inflation of the rubber pads 31 with compressed air, the sidewalls of products 1 are then pressed against the core 30 and are held fast by the gripper head 28 when it is raised. The core 30 is designed with vertical recesses and partitions in such a way that the gripped products 1 are aligned and centered to be fitted exactly into the recesses of a positioned tray 2.

As one group 6 of, for the example, ten products 1 is being aligned and segregated, an individual empty tray 2 is positioned at the tray filling station 7 for reception of the group 6 of sticks. To this end, a new tray 2 is lifted off a stack of trays by means of a tray unstacking unit 8 and is placed, preferably by free fall, onto a second conveyor belt 9 oriented in the widthwise direction. The conveyor belt 9 transports the tray 2 in the conveying direction 33 to a tray loading stop 34 where each individual tray 2 is in position to be moved lengthwise into the filling station.

Figure 4:
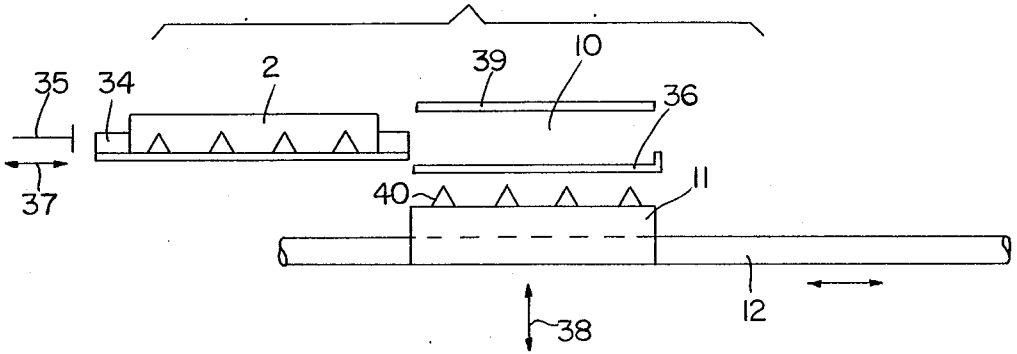
FIG. 4 is a diagrammatic side view illustrating a means for automatically positioning a tray on the carriage of the apparatus of FIG. 1.

At the end stop 34, each individual tray 2 is pushed lengthwise by means of cross-slide 35 into a guide 36, as shown in FIG. 4. In the position reached by a horizontal stroke 37, the tray 2 overlies a carriage 11 mounted on a rail 12, which carriage 11 engages and supports the tray 2 by a vertical stroke 38 towards another end stop 39. The stroke 38 establishes a form-locking connection between recesses or partitions in the tray 2 and studs 40 provided on the carriage 11 in such a way that the tray 2 is centered without any tolerance on the carriage 11.

The tray 2, centered on the carriage 11, is brought into the tray filling station 7 by automatic movement of the carriage on the rail 12. At the tray filling station 7, the group 6 of products 1 held firmly in the gripper head 28 is lowered into the tray 2 by the handling unit 5 following a lift-and-turn movement. After deflation of the rubber pads 31 (FIG. 2), the products 1 are released and remain behind in the tray 2 when the gripper head 28 is raised again.

Figure 3:
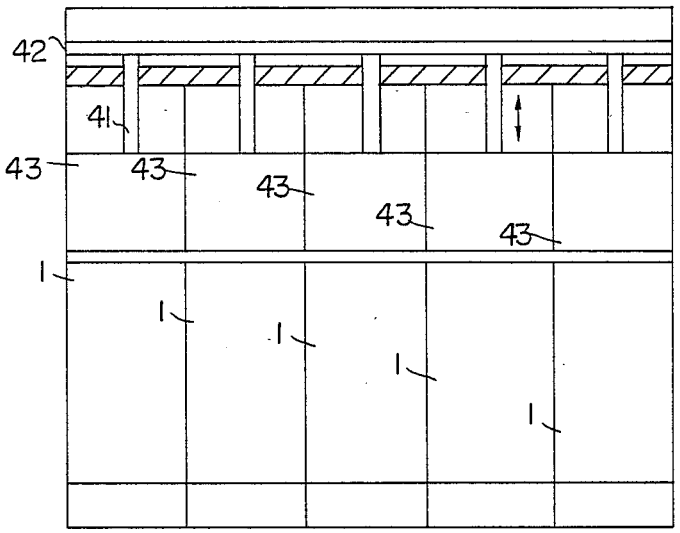
FIG. 3 is a vertical section through the gripper head shown in FIG. 2.

To obtain safe release of products 1 having relatively loose caps 43, shown in FIG. 3, such as lipstick or glue containers, from the gripper head 28, metal release pins acting as strikers 41 are provided on a lift plate 42 of the gripper head 28 in the embodiment illustrated in FIG. 3. The strikers 41 push the products 1 and the caps 43, placed loosely thereon during production, straight out of the core 30 of the gripper head 28 so that not only are the containers safely released from the gripper head 28, the caps 43 also remain on the containers. This is important in the case of lipstick containers or other containers having axial caps which are not threadably-engaged and can slip off during vertical movement.

Figure 5:
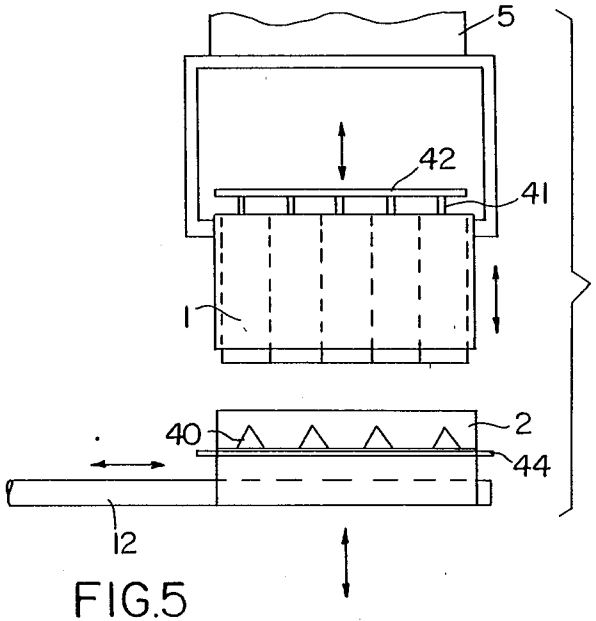
FIG. 5 is a diagrammatic side view illustrating the positioning of a tray in the filling station for the reception of a group of sticks or containers.

After the filling of each tray 2, the carriage 11 supporting the tray is released vertically downwards out of engagement with the filled tray 2 and returned over rail 12 to its position beneath the tray positioning station 10 receive another tray. The tray loaded with products 1 is supported by the stripping edges 44 at each side of rail 12, as shown in FIG. 1 and 5, and then transferred to the output conveyor belt 13 by means of another cross-slide 45.

This transfer of a filled tray 2 completes the loading cycle. In the embodiment illustrated about sixty products 1, such as containers of approximately 30 ml capacity having an external diameter of around 30 mm and an external length of 110 mm, can be automatically placed in trays every minute.

It will be apparent that the present method and apparatus are suitable for use in packaging a large variety of uniform slender products which are self-standing for upright movement on a conveyor surface and which are to be grouped and aligned within recesses or compartments of uniform trays for sale or display purposes. Such products may be containers for liquids or solids, plastic or glass or metal vials, rods or tubes, provided that they are self-standing and have the necessary dimensions relative to the gripper head.

It is to be understood that the above described embodiments of the invention are illustrative only and that modifications throughout may occur to those skilled in the art.

We claim:

1. A device for placing at least two rows of articles in a receiving tray having a plurality of recesses therein to support said articles in an upright position; said device comprising a first conveyor belt on which said articles, standing upright, are delivered individually and aligned in parallel rows to a preliminary loading station and thereat said articles are divided into a group having a predetermined number of articles; a tray unstacking means associated with a tray conveyor belt leading to a tray positioning station; said tray positioning station being connected to a tray carriage which is movable over a guide rail to a tray filling station; a handling device for gripping and raising said group having a predetermined number of articles to a loading station and for placing said group of articles into said receiving tray at said tray filling station; said handling device being adapted to rotate about an axis which is conveyed linearly between two stations and consisting essentially of a gripper head having a centering frame with a rigid core portion conforming to the outer surface contours of said group of articles, and inflatable rubber pads mounted int he lateral boundaries of said gripper head which are connected to compressed air supply lines; and an output conveyor for transporting the receiving tray away from said tray filling station.

2. A device as in claim 1 wherein said rigid core portion has vertical recesses and partitions to align and center said group of articles and into which said articles are pressed by inflating said rubber pads and enable lifting said group of articles.

3. A device as in claim 1 wherein said gripper head has a lift plate with vertically movable release pins designed as strikers to provide safe release of said group of articles.

4. A device as in claim 3 wherein said strikers are adapted to simultaneously eject said group of articles into said receiving tray in an upright position.

5. A device as in claim 3 wherein said strikers are adapted so that loosely placed caps on said articles are not removed from said articles when contacted with said strikers.

6. A device as in claim 1 wherein said tray carriage is adapted in said tray filling station as to be releasable vertically downwards out of engagement with said receiving tray.

7. A device as in claim 1 including means for transferring said receiving tray from said tray filling station to said output conveyor.

8. A device as in claim 7 wherein said means for transferring said receiving tray from said tray filling station to said output conveyor comprises a cross-slide.

9. A device as in claim 1 wherein an article alignment tongue is mounted in the path of said articles to pivot about a vertical axis at a predetermined distance above said first conveyor belt and alternatingly guide said articles into a plurality of tracks of said preliminary loading station.

10. A device as in claim 1 wherein said preliminary loading station is provided with rotatably mounted pivotal flaps to retain said articles and enable dividing said articles into said predetermined number of articles.

11. A device as in claim 10 wherein said pivotal flaps are adapted to be operated pneumatically.

12. A device as in claim 1 wherein said handling device is adapted to be operated pneumatically, said gripper head is fixed to a rotary unit and is movable in a vertical plane as well as being rotatably movable.

13. The method of loading at least two rows of articles into a receiving tray having a plurality of recesses therein to support said articles in an upright position, comprising providing a continuous supply of said articles in an upright position on a conveyor surface, aligning said articles into a plurality of parallel rows corresponding to the recesses in said receiving tray, segregating said articles into a group of articles corresponding to the recesses in said receiving tray, sequentially moving said group of articles into a gripping station, gripping said group of articles as a unit and lifting then rotating horizontally through about 90° said group of articles into a loading station having a receiving tray positioned therein, lowering said group of articles onto said receiving tray, releasing said group of articles, and replacing the loaded receiving tray with an empty tray to receive another group of said articles from the gripping station.

14. The method of claim 13 including moving a continuous supply of empty receiving trays, one at a time, into said loading station, and moving each loaded receiving tray out of said loading station.

15. The method of claim 14 including moving each empty receiving tray onto a tray-supporting carriage, moving said carriage and supported tray into said loading station, and retracting said carriage to receive another empty receiving tray while the loaded receiving tray is moved out of the loading station.

16. The method of claim 13 including gripping each group of articles by applying pressure against the side walls thereof, and releasing each group of articles by relaxing said pressure.

17. The method of claim 16 wherein said articles have loose, frictionally-engaged caps, and downward pressure is applied against said caps during the release of said articles into said receiving tray.

18. The method of claim 13 including moving said articles into a plurality of rows by confining the articles between guide walls forming each row.

19. The method of claim 13 including moving said empty receiving tray into the loading station at an angle relative to the direction of movement of each group of articles into the gripping station, and rotating each group of gripped articles during their movement into the loading station.

* * * * *